US007300622B2

(12) United States Patent
Lu et al.

(10) Patent No.: US 7,300,622 B2
(45) Date of Patent: Nov. 27, 2007

(54) DEVICE FOR GENERATING NANOSTRUCTURES

(75) Inventors: Jian Lu, Troyes (FR); Ke Lu, Shenyang (CN)

(73) Assignees: Universite de Technologies de Troyes (FR); The Institute of Metal Research (JP)

( * ) Notice: Subject to any disclaimer, the term of this patent is extended or adjusted under 35 U.S.C. 154(b) by 0 days.

(21) Appl. No.: 11/532,314

(22) Filed: Sep. 15, 2006

(65) Prior Publication Data

US 2007/0006943 A1 Jan. 11, 2007

Related U.S. Application Data

(62) Division of application No. 10/343,009, filed as application No. PCT/FR01/02482 on Jul. 27, 2001.

(30) Foreign Application Priority Data

Jul. 28, 2000 (FR) ..... 00 09950

(51) Int. Cl.
*C23C 8/00* (2006.01)
*C21D 8/00* (2006.01)
*B24B 39/00* (2006.01)

(52) U.S. Cl. ..... 266/249; 72/53; 148/241; 148/281

(58) Field of Classification Search ..... 148/241, 148/281, 284; 266/249; 72/53
See application file for complete search history.

(56) References Cited

U.S. PATENT DOCUMENTS 5,212,976 A 5/1993 Company
7,147,726 B2 * 12/2006 Lu et al. ..... 148/240
2004/0038626 A1 2/2004 Lu et al.

FOREIGN PATENT DOCUMENTS

FR 2689431 A 10/1993
GB 2119408 A 11/1983

(Continued)

OTHER PUBLICATIONS

Plaster, Technical Aspects of Shot Peening Machinery and Media, 1981, Conf Proc: ICSP-1, p. 83-94, Dec. 1981.

(Continued)

*Primary Examiner*—Scott Kastler
(74) *Attorney, Agent, or Firm*—Miles & Stockbridge P.C.; Edward J. Kondracki

(57) ABSTRACT

The present invention concerns a method for generating nanostructures in order to obtain in an area on the surface of a metal piece (10) a nanostructured layer of defined thickness, characterized in that it comprises: a step for projecting onto an impact point in the area of the surface of the piece (10) to be treated, for a given duration, at a given speed and at variable incidences at the same impact point, a given quantity of perfectly spherical balls (22) of given dimensions, reused continuously during the projection; repetition of the preceding step with a shift of the impact point so that the impact points as a group cover the entire surface of the piece to be treated; a step for treatment by diffusion of chemical compounds into the nanostructured layer generated during the step for implementing the method for generating nanostructures.

9 Claims, 5 Drawing Sheets

FOREIGN PATENT DOCUMENTS

WO WO 9523876 A 9/1995

OTHER PUBLICATIONS

Tao, N.R. et al., "Surface Nanocrystallization of Iron Induced by Ultrasonic Shot Peening", Nanostructure Materials, Elsevier, NY, vol. 11, No. 4, Jun. 1999, pp. 433-440, XP004178991 ISSN: 0965-9773.

Diepart, C.P.: "Le Grenallage de Precontrainte Controlled Shot Peeing", Mecanique Materiaux Elecricite, FR, Editions Science et Industries, Paris; No. 440, Sep. 1, 1991, pp. 36-39, XPP000264969.

Lu et al., "Surface Nanocrystallization (SNC) of Metallic Materials-Presentation of the Concept behind a New Approach", 1999, Mater. Sci. Technol., vol. 15, No. 3, p. 193-197, Dec. 1999.

Dossett, "ASM Handbook", 1995, ASM International, vol. 4, 376, 387-391, 420, Dec. 1995.

Database WPI Week 991, Derwent Publications Ltd., London, GB, AN 1992-094796, XP002165351 & SU 1 655 997 A (D.L. Lipsman) Jun. 15, 1991—Abstract.

Database WPI, Week 9912, Derwent Publications Ltd., London, GB; XP-002165351 and SU 1 655 997 A (D. L. Lipsman) Jun. 15, 1991 Abstract.

Office Action of Jan. 18, 2007, in U.S. Appl. No. 10/343,009, filed May 5, 2003.

* cited by examiner

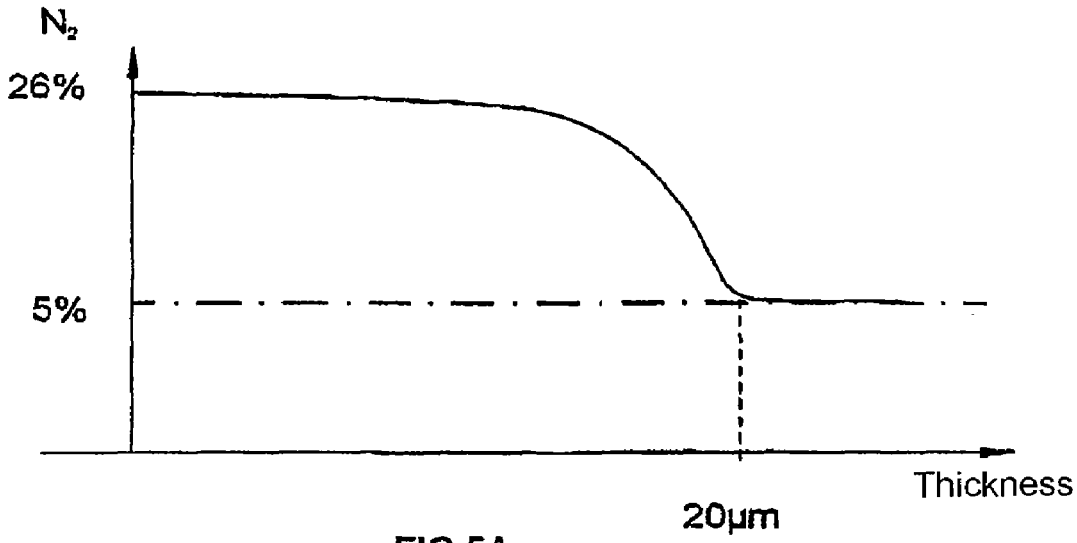
FIG 5A
FIG 5B
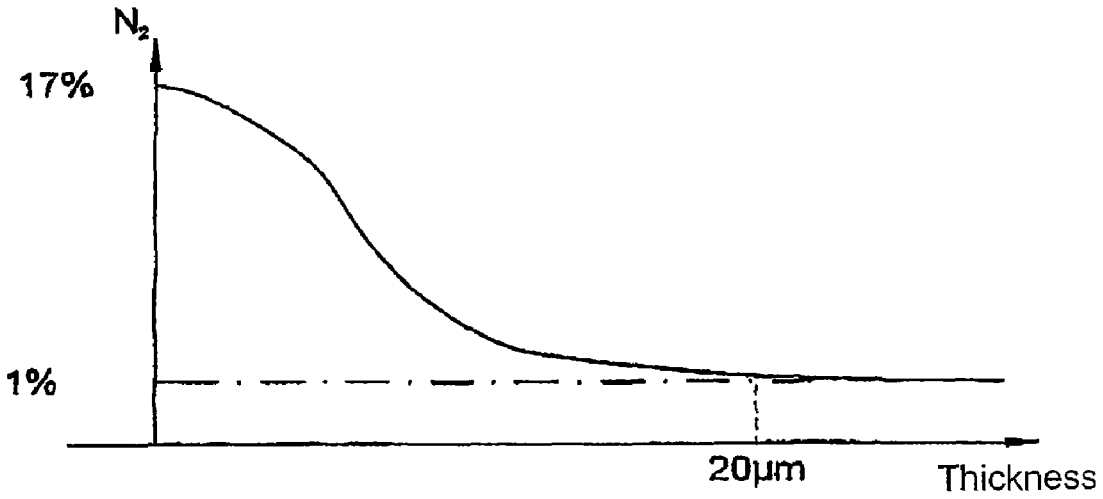

DEVICE FOR GENERATING NANOSTRUCTURES

CROSS REFERENCE TO RELATED APPLICATIONS

This application is a division of co-pending application Ser. No. 10/343,009 filed May 5, 2003, which is the National Stage of International Application No. PCT/FR01/02482 filed Jul. 27, 2001, under 35 USC §371. This application also claims foreign priority to application FR 0009950 filed on Jul. 28, 2000.

The subject matter of the subject invention is related to application Ser. No. 10/343,012 filed on Jan. 27, 2003 (U.S. Patent Publication No. 2004/0038626 published on Feb. 26, 2004), in the names of Jian LU and Ke LU, entitled "MECHANICAL METHOD FOR GENERATING NANOSTRUCTURES AND MECHANICAL DEVICE FOR GENERATING NANOSTRUCTURES," the subject matter of which is incorporated herein in its entirety.

BACKGROUND OF THE INVENTION

1. Field of the Invention

The present invention concerns a method for generating nanostructures on metal pieces and a device for generating nanostructures.

Nanocrystalline materials are characterized by ultrafine grains, typically with at least one dimension of less than 100 nm. These materials are produced using known methods such as, for example, IGC (inert gas condensation and consolidation), SPD (severe plastic deformation), etc. These methods have the drawback of generating materials that are neither porosity-free nor contamination-free, nor of sufficient size for industrial applications.

The purpose of the method of the invention is to create on the surface of the material a layer of this same material having constituent grains of several tens of nanometers, forming what is commonly called a layer of nanometric microstructures, or nanostructures.

There are conventional peening methods that are known in the prior art. Peening the surface of a material, for example a metal, consists of shooting projectiles of small size, for example balls, at speeds between 5 and 100 mps. In this prior art, the balls are projected by means of a blast of compressed air. In this method of peening, the balls are not immediately reused, and pass through a recycling device before being fed back to the blast nozzle. Moreover, each blast that is incident on the piece is unidirectional, at a given angle for a given surface. In addition, a continuous sweep of the piece is required during the peening in order to obtain a homogeneous surface. Furthermore, the results obtained show that the surface of the treated piece comprises few or no nanostructures. The only advantage of the conventional peening process resides in the fact that it is possible to obtain higher ball speeds than in the generation of nanostructures using ultrasound. In essence, generating nanostructures using ultrasound makes it possible to obtain ball speeds between 5 and 20 mps, whereas pneumatic blast nozzle peening makes it possible to obtain ball speeds between 10 and 100 mps.

2. Description of the Related Art

There is also a method for ultrasonic hardening of metal pieces known from French patent application 2,689,431 or Russian patent application 1,391,135, which consists of setting balls in motion inside an enclosed volume for a given amount of time, using an ultrasound generator. In the method of the French patent application, it is possible to obtain, as a function of the speed, either a given roughness, or a given hardened layer depth. In order to obtain a uniform treatment, the travel speed of the transmitter must conform to a certain value, below which there is strain hardening of the surface and above which the treatment is no longer uniform, meaning that some point on the surface will not have been hit even once. The speeds envisaged in this patent application are no more than several tens of centimeters per second, and the amplitude of the transmitter is 100 μm. Thus, the known operating mode does not make it possible to create a hardened layer without obtaining a nanometric structure to a significant depth.

SUMMARY OF THE INVENTION

The object of the present invention is to eliminate the drawbacks of the prior art by offering a method for generating nanostructures that makes it possible to obtain, in a defined area of a piece to be treated, physicochemical properties that cannot be obtained in the usual methods.

This object is achieved by the method for generating nanostructures so as to obtain on a defined area of the surface of a metal piece a nanostructured layer of defined thickness, characterized in that it comprises:

- a step for projecting onto an impact point in the area of the surface of the piece to be treated, for a given duration, at a given speed, from a given distance, and at variable incidences at the same impact point, a given quantity of perfectly spherical balls of given dimensions, reused continuously during the projection,
- repetition of the preceding step, with a shifting of the impact point so that the impact points as a group cover the entire surface of the piece to be treated,
- a step for treatment by diffusion of chemical compounds into the nanostructured layer generated during the step for implementing the method for generating nanostructures.

Another object of the invention consists of offering a device for generating nanostructures that makes it possible to obtain given physicochemical properties in a piece.

This object is achieved by means of the device for generating nanostructures in a given thickness of a metal piece, comprising means for setting in motion, at a given speed, balls of given dimension, characterized in that the balls used are perfectly spherical and that the means for setting them in motion at a given speed include means for obtaining variable angles of incidence for the same impact point, means for reusing the balls, and means for diffusing a chemical compound in a sealed chamber.

BRIEF DESCRIPTION OF THE DRAWINGS

The invention and its characteristics and advantages will emerge more clearly with the reading of the description given in reference to the attached drawings, in which:

FIGS. 5A and 5B represent the curve representing the level and the penetration of nitrogen during an ion nitriding treatment in a piece treated using the method for generating nanostructures according to the invention, for a temperature of 550° C. and 350° C., respectively.

DESCRIPTION OF THE PREFERRED EMBODIMENTS

The principle of the invention is to perform a treatment of the surface of a metal piece in order to modify the mechanical properties of the metal piece, while benefiting from a modification of the diffusion properties in the superficial layer of the treated surface.

In the prior art, the mechanical properties of nanometric microstructures, or nanostructures, are well known. In essence, the smaller the size of the metal grains, the greater the mechanical strength of the piece. Thus, current research is seeking to develop methods of fabrication for obtaining pieces constituted only of nanostructures. The subject of the invention is entirely different; it consists of using a process for generating nanostructures (described below) to create a superficial nanostructured layer that gives the entire piece the desired properties, for example mechanical properties (fatigue, abrasion or friction, stress corrosion, etc.), this being enough to guarantee the properties desired for the piece.

In order to obtain a nanostructure, it is necessary to reduce the size of the metal grains on the surface of the piece. Initially, for a piece made, for example, of pure iron, the grains have a dimension on the order of 100 μm. After the peening treatment according to the invention, the size of the grains is on the order of only several tens of nanometers. In order to reduce the size of the grains on an entire surface, it is necessary to create on the surface of the material a plastic deformation in all directions in a random fashion.

Figure 1:
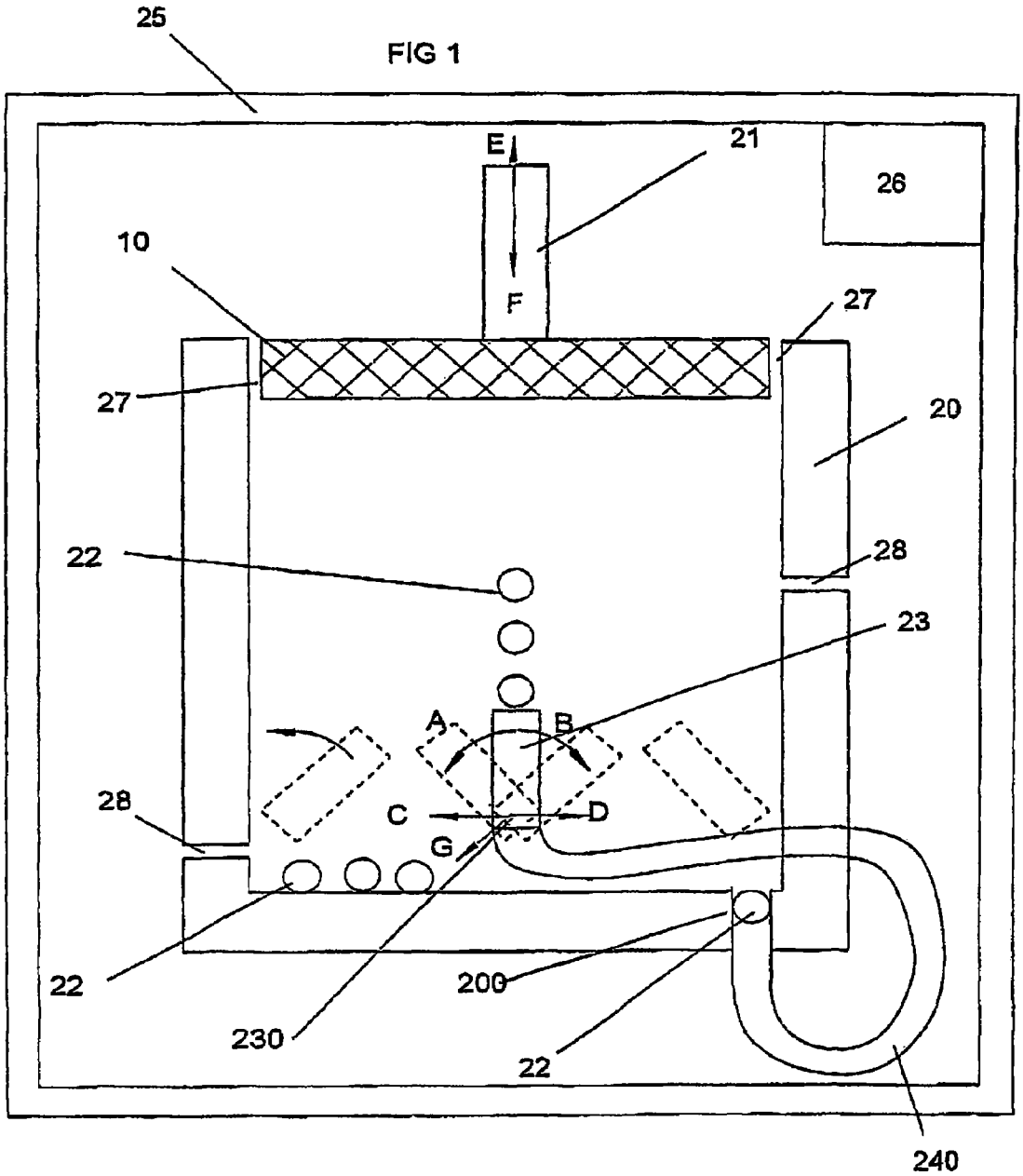
FIG. 1 represents a diagram of a device for generating nanostructures by bombardment.

FIG. 1 represents a diagram of a device for generating nanostructures by bombardment in an acoustic isolation chamber (25). As explained above, a method for generating nanostructures using ultrasound or compressed air is already known. However, the results obtained with this method are not sufficient in many cases. In fact, microstructures are obtained in a very small thickness of the piece, on the order of one micron. The principle of generating nanostructures by bombardment according to FIG. 1 is to set the balls (22) in motion using a nozzle (23) for projecting perfectly spherical balls (22). The nozzle (23) is mounted, in a chamber (20) whose walls allow the balls to ricochet, on an axis of rotation (230) so as to be able to pivot in the directions A, B in order to sweep, starting from a given position on the axis of rotation (230), the entire surface to be treated. Moreover, the axis of the nozzle is mounted on an assembly that can travel in three directions (C, D, G) parallel to the surface to be treated. Thus, in their movement, the balls (22) will hit each surface element of the piece (10) a large number of times, in different and varying directions of incidence, creating with each impact a plastic deformation of the grains constituted by an agglomerate of molecules of the material or the alloy, in any direction. The piece (10) is held in position by gripping means (21) that lock the piece (10) both translationally and rotationally, and make it possible to adjust the distance of the piece from the source emitting the projectiles. Likewise, the chamber includes means for recovering and rapidly recycling the balls to the nozzle (23) so that only a given quantity of balls is used in the chamber of the device. These means are, for example, constituted by a shape of the chamber, for example in the form of a conical or hemispherical basin, that promotes the recovery of the balls by gravity, and an opening (200) located in this area for leading, through a flexible system (240) the balls to the nozzle (23). In another type of disposition, the nozzle can be fixed, and the piece is set in a similar motion. Diffusing or vaporizing means (26) are disposed in the sealed acoustic chamber (25), making it possible to perform one or more of the chemical or thermochemical treatments described below, possibly associated with means for heating the chamber or the piece. Each device for generating nanostructures is in an unsealed form for chemical treatments by diffusion or vaporization or another method. Thus, the bowl (20) can be provided with channels (28) for circulating fluids, or a space (27) can be provided between the piece to be treated or its support and the bowl (22).

The generation of nanostructures on the treated surface of the piece causes a modification of the law of diffusion in the treated area. In essence, the multiplication of the metal grains also multiplies the number of boundaries between the grains. These boundaries constitute nanometric channels that allow the diffusion of chemical compounds having a size on the order of several atoms. Thus, these compounds can penetrate more deeply and more completely into the treated surface of the piece, making it possible to obtain advantageous mechanical, physical or chemical properties.

Thus, all of the surface treatment methods involving the diffusion of compounds into the surface of a metal piece are modified when the piece has been previously subjected to the method for generating nanostructures according to the invention, or is subjected to the method for generating nanostructures at the same time.

As an example, FIGS. 5A and 5B represent the curve representing the level and the penetration of nitrogen during an ion nitriding for a temperature of 550° C. and 350° C. The curve represented in FIG. 5A corresponds to the measurement of the level of nitrogen as a function of the thickness of the treated surface, when the piece has been subjected to a nitriding for two hours at a temperature of 550° C. The solid curve corresponds to the measurement produced for a surface pre-treated using the method for generating nanostructures according to the invention. The treatment for generating nanostructures on the surface made it possible to obtain a nanostructure in a thickness of about 20 μm. The dot-and-dash curve corresponds to the measurement produced for a surface not treated by generating nanostructures. We can see from the dot-and-dash curve that according to the prior art, the level of nitrogen that has penetrated for the nitriding treatment at 550° C. is uniform in the thickness of the piece and is equal to 5%. For the piece pre-treated by generating nanostructures according to the invention, the level of nitrogen, under the same operating conditions, is five times greater than the level in the untreated piece, in the thickness in which the nanostructures have been formed. After that, in the thickness of the piece that does not include any nanostructures, the level of nitrogen decreases rapidly to a level corresponding to the level obtained in the nitriding method of the prior art. This treatment makes it possible to obtain microstructures of material that are more advantageous in terms of fatigue, fretting fatigue and contact fatigue.

The curve represented in FIG. 5B corresponds to the measurement of the level of nitrogen as a function of the thickness of the treated surface when the piece has been subjected to a nitriding for two hours at a temperature of 350° C. The solid curve corresponds to the measurement produced for a surface pre-treated using the method for generating nanostructures according to the invention. The dot-and-dash curve corresponds to the measurement produced for a surface not treated by generating nanostructures. The treatment for generating nanostructures on the surface made it possible to obtain a nanostructure in a thickness of 20 μm. We can see that according to the prior art, the level of nitrogen is uniform in the thickness of the piece and is equal to 1%. This level is much too low to satisfactorily modify the mechanical properties of the surface of the piece.

For the piece pre-treated by generating nanostructures according to the invention, the level of nitrogen is 17 times greater than the level in the piece whose surface is untreated. After that, the level of nitrogen gradually decreases in the thickness of the piece comprising the nanostructure, and ends up being equal to the level obtained according to the nitriding process of the prior art where the layer of the piece does not include any nanostructures.

It should be noted that the nitriding process according to the prior art can only be performed beginning at a certain temperature, for example near 550° C., for apiece made of pure iron. It is therefore clear that pre-treating the piece makes it possible not only to obtain a good structure on the surface of the piece, but also to lower the treatment temperature while retaining, in the case of the treatment at 350° C., a level of nitrogen greater than the level obtained without treatment by generating nanostructures according to the invention.

Thus, with the lowering of the treatment temperature, it becomes possible to perform nitriding on pieces which, in the prior art, could not be subjected to nitriding. In fact, nitriding must be performed at a temperature of approximately 550° C., although at this temperature a metal piece is necessarily subject to deformation. For pieces in which geometric precision is essential, such deformation is unacceptable, and consequently prohibits any nitriding according to the method of the prior art. By applying the method for generating nanostructures according to the invention prior to the nitriding, it is possible to lower the treatment temperature and hence to reduce or eliminate the deformation of the piece. As a result, precision pieces can be subjected to nitriding, which was impossible in the prior art.

Likewise, the pre-treatment according to the method of the invention for generating nanostructures also makes it possible to reduce the treatment time. In fact, the presence of nanostructures, and in particular nanometric diffusion channels, allows faster diffusion of the compounds into the superficial layer of the piece.

That which is explained above for nitriding is also true for any surface treatment or physicochemical surfacing method that depends on the law of diffusion in the superficial layer of a piece. Thus, methods for case hardening, carbonitriding, ion implementation, or ion catalysis or storage in a metal structure are modified when the piece has been previously subjected to the process for generating nanostructures according to the invention, i.e., when it comprises a layer of nanometric microstructures in a thickness of ten or several tens of microns.

Figure 2A:
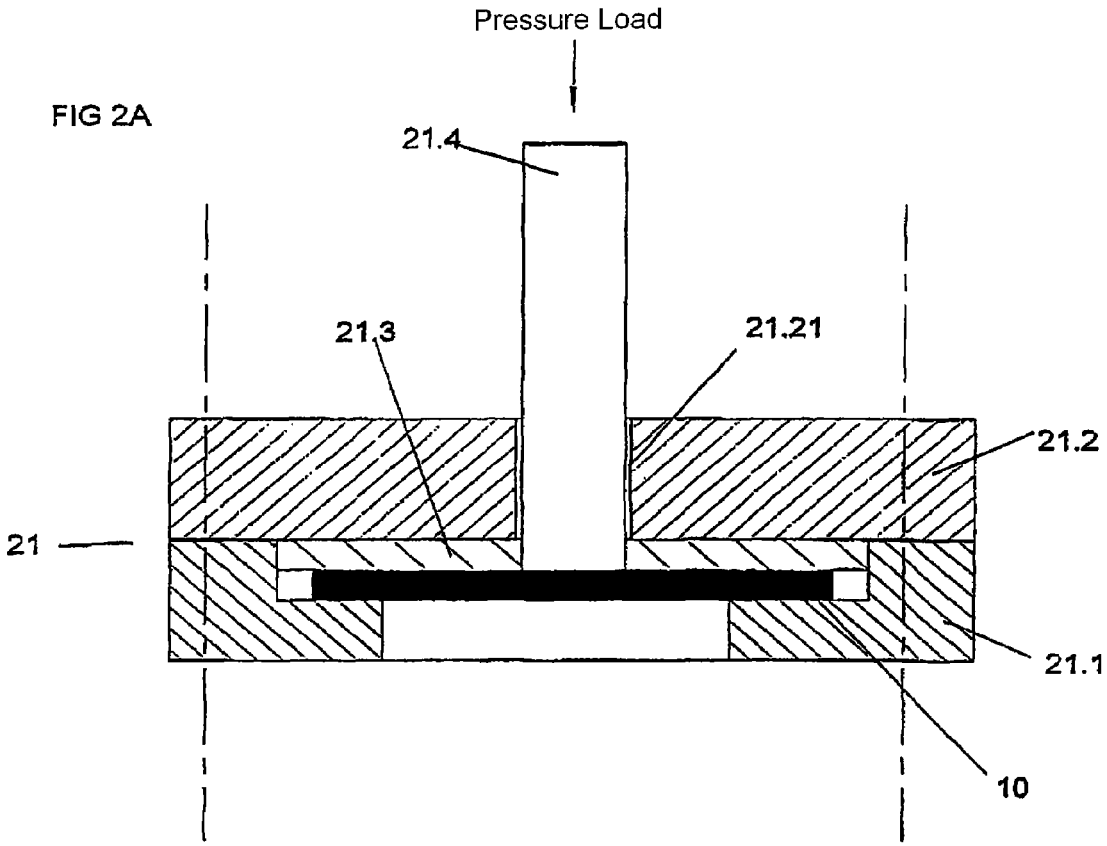
FIG. 2A represents a cross-section of a variant of embodiment of the device in which stress is applied.
Figure 2B:
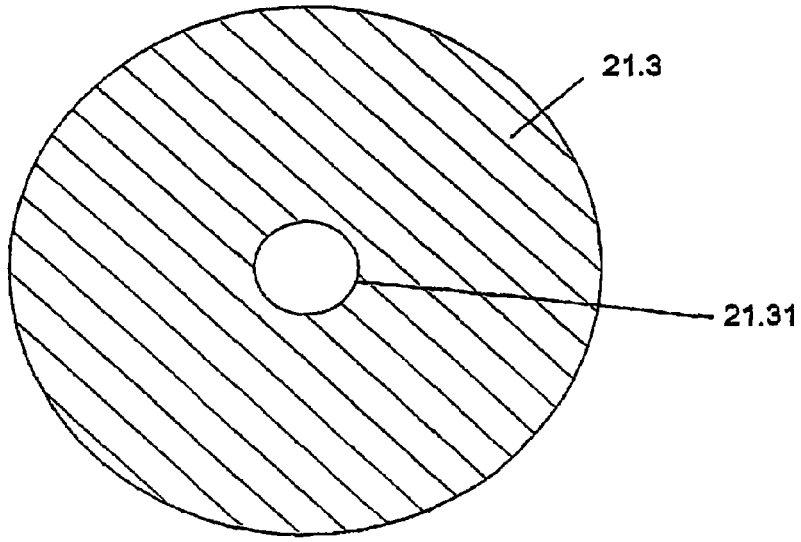
FIG. 2B represents a sectional top view of the shim used in the variant of embodiment of the invention in which stress is applied.

According to a variant of embodiment represented in FIG. 2, the surface to be treated can be placed under mechanical stress, for example by clamping the piece (10) with appropriate gripping means (21), These gripping means are, for example, constituted by a base plate (21.2) on which are mounted clamps (21.1) for clamping the piece against a protective shim (21.3) inserted between the piece (10) and the base plate (21.2). A rod (21.4) passing through the base plate (21.2) and the shim (21.3) applies a load to the piece (10) retained by the clamps (21.1). The pressure load can be obtained by threading the rod 21.4 and screwing it into a threaded hole (21.21) formed in the base plate (21.2).

The invention is not limited to the embodiments described, but encompasses any embodiment that makes it possible to apply mechanical stress to one or more places on a piece. Thus, several rods can be provided in order to apply different stresses in several places so as to obtain different nanostructured thicknesses, proportional to the value of the stresses applied at the respective points.

Figure 3A:
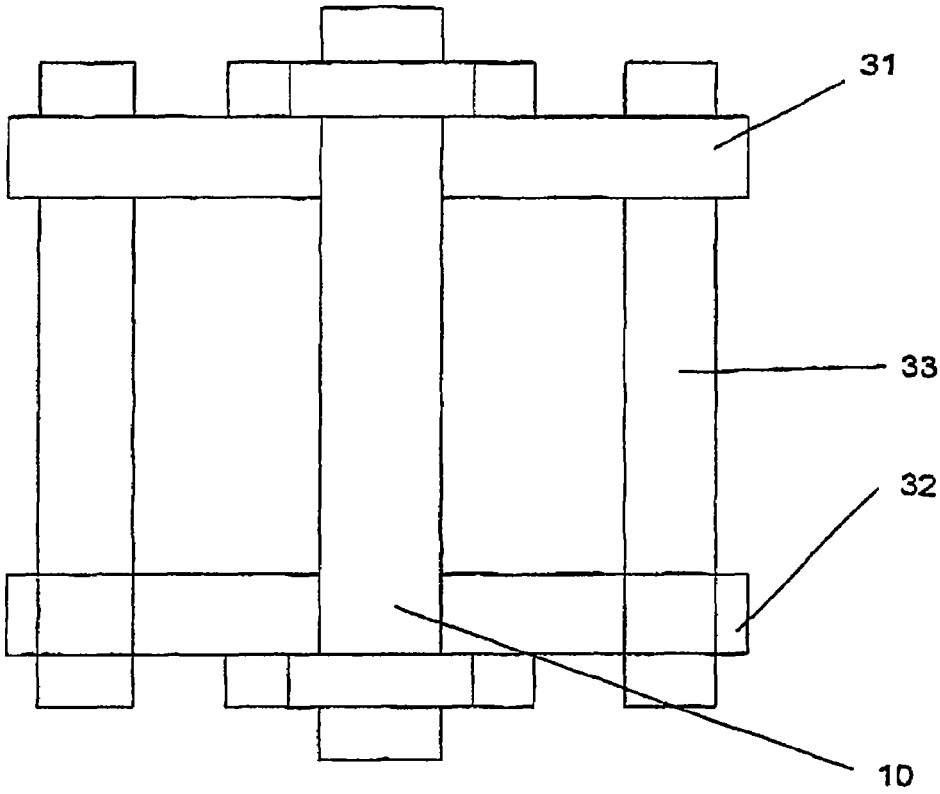
FIG. 3A represents an elevation of a second variant of embodiment of the invention in which stress is applied.
Figure 3B:
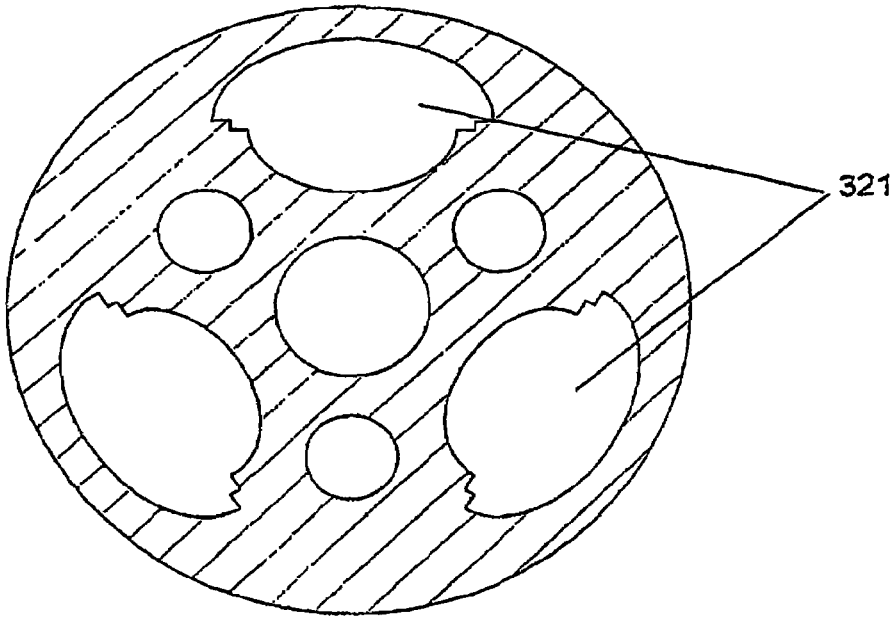
FIG. 3B represents a top view of the bottom plate of the second variant of embodiment with stress.

In the embodiment of the stressing device represented in FIG. 3A, means for exerting traction on each of the ends of the piece make it possible to place it under stress. These means are constituted, for example, by a top plate (31) and a bottom plate (32) held apart at a distance adjustable by means of three screw rods (33) disposed at 120° and exerting tractional stress on the ends of the piece joined to each plate. The piece can, for example, pass through each plate via openings and press against the outward-facing surface of each plate by means of rings forming shoulders and joined to the ends of the piece by a locking screw at a right angle to the ring. The plates, particularly the one (32) facing the projectile emission area, are provided, as represented in FIG. 3B, with cutouts that allow the circulation and the projection of the balls.

Figure 4:
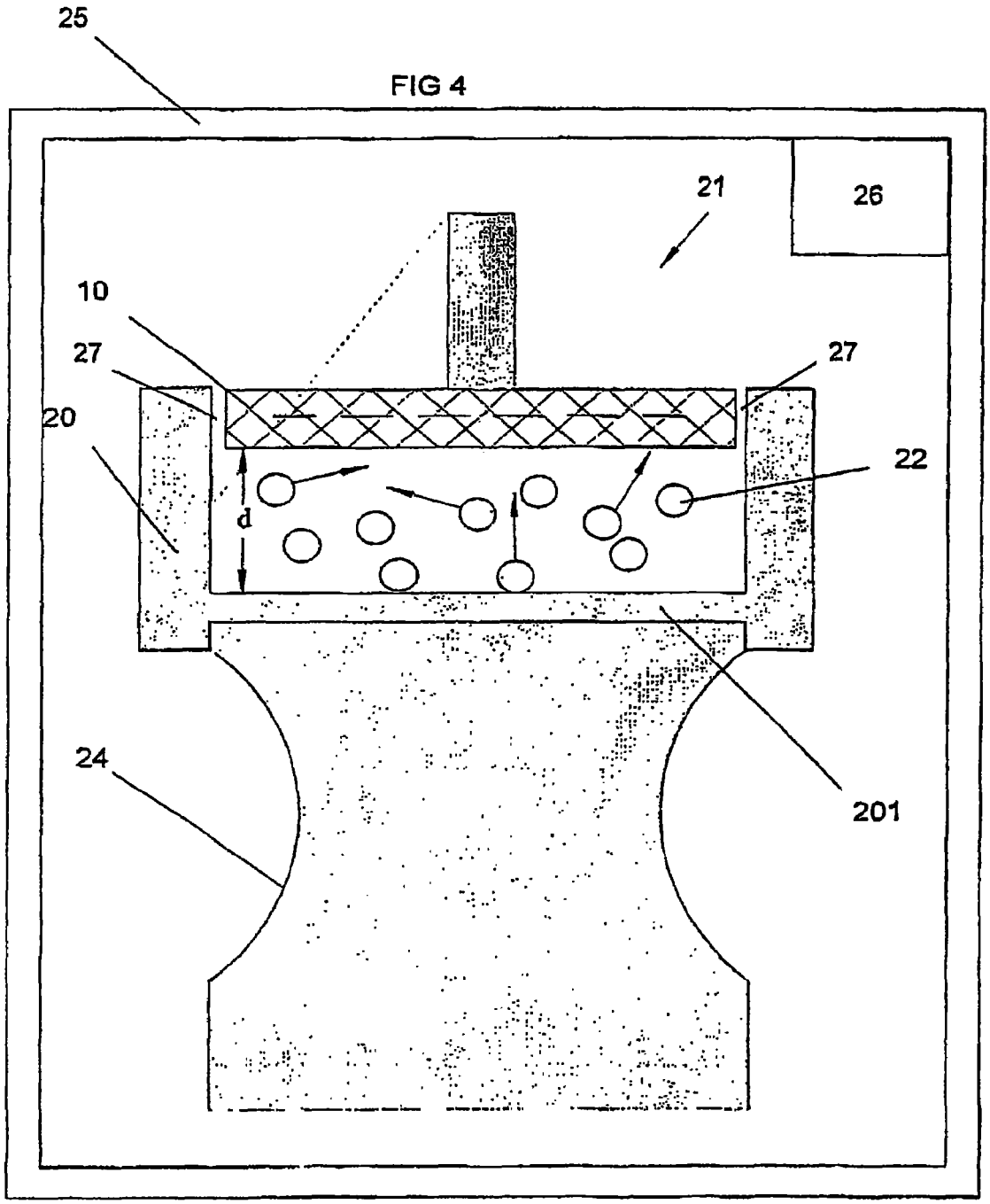
FIG. 4 represents a diagram of another device for generating nanostructures using ultrasound, which is usable with the stressing devices represented in FIG. 2.

FIG. 4 represents a diagram of another device for generating nanostructures using ultrasound, which can be used to implement the invention, possibly with the stressing device represented in FIG. 2. The ultrasonic device of FIG. 4 can also be used with the device of FIG. 3. In this variant of embodiment, the sonotrode (24) is joined to a bowl (20) whose top opening is blocked by a device (21), for example of the type in FIG. 2, for placing the piece (10) to be treated under stress. The device (21) is mounted relative to the bowl (20) on means that make it possible to adjust the distance between the surface exposed to the bombardment and the bottom of the bowl (201), which constitutes the emission surface of the balls (22). The principle of setting the balls in motion using ultrasound is to set the balls (22) in motion by means of an ultrasonic generator (24) operating at a given frequency, which communicates a movement of given amplitude and speed to the bowl (20). The amplitude of the movement of the sonotrode could be chosen so as to be from a few microns to a few hundred microns. The balls (22) draw their energy from the movement of the bowl and hit the surface of the piece (10) a large number of times, at variable and multiple incident angles, creating with each impact a plastic deformation of the grains constituted by an agglomerate of molecules of the material or the alloy, in any direction. A ball that loses its energy in contact with the piece bounces off the walls of the bowl so as to acquire a new speed in a direction which, seen from the piece, seems random but is determined by physical laws.

In another variant of embodiment, the stress applied can be thermal. Thus, the surface to be treated is heated, either completely so as to obtain a uniform thickness of nanocrystalline structures on the entire surface of the piece subjected to the ball bombardment, or locally so as to obtain variations in the thickness of nanocrystalline structures. In this case, means for heating by radiation, conduction or convection are installed in the bowl, on the piece, or in the acoustic chamber of the machine.

In addition, it is possible to combine the mechanical stress with a heating of the surface to be treated in order to obtain the desired result. The purpose of applying stress and/or raising the temperature is to allow easier generation of the plastic deformation, in the underlying layer and in all directions, so as to promote the fractionation of the grains of material located at a depth.

Tests currently performed by bombarding a piece not placed under stress have made it possible to produce nanostructured layers of up to 20 μm; by applying stress, nanostructures are obtained in a thickness of several hundred microns or more. The increase in the thickness of the nanostructured layer can be produced by finding a compromise between the value of the stress and the increase in the temperature. The choice of the various parameters involved in the method for generating nanostructures is also important.

Thus, experience has shown that the larger the diameter of the balls used, within a range of dimensions on the order of a few hundred microns to a few millimeters, the larger the nanostructured layer obtained. Likewise, the treatment time is involved in determining the thickness of the nanostructure. It has been noted that up to a given time value, which is different depending on the size of the balls, the more the time increases, the more the thickness of the nanostructured layer increases up to a time that corresponds to saturation and allows no further modification of the thickness of the layer. This given value is obtained either through experience, or from a mathematical model for a given material. However, when the time becomes greater than the given value, the thickness of the nanostructured layer decreases. This phenomenon is due to the fact that the impact of the balls on the surface to be treated generates an emission of heat, which heats up the material. Beginning at a certain threshold, the result of the heat is to increase the size of the metal grains.

The general principle for choosing the parameters of the method for generating nanostructures according to the invention is that the greater the kinetic energy of the balls, the greater the level of stress generated in the underlying layer. The upper limit of the kinetic energy is defined particularly by the heating caused by the release of this kinetic energy during the impact on the surface to be treated, and by the mechanical strength of the balls and of the material constituting the piece. This drawback can be mitigated or eliminated by cooling the chamber or the piece with a cooling system. In essence, as explained above, a temperature increase tends to enlarge the metal grains, and the material must not crack.

Other parameters may be acted on in order to obtain larger nanostructured layers or to reduce the treatment time. For example, the hardness of the balls plays a role, particularly in the transfer of kinetic energy from the ball to the surface of the piece. Likewise, when an ultrasonic generator is used to set the balls in motion, the acoustic pressure generated by the sound waves also influences the nanostructure generating process. Likewise, according to the invention, the ultrasonic generation of nanostructures the projection of streams of balls can be achieved in a medium containing a specific given gas that modifies the mechanical behavior or the chemical composition of the surface of the material during the impacts of the balls.

For example, in order to obtain a nanostructured layer of about 20 μm, it is necessary to expose the surface to be treated to an ultrasonic generation of nanostructures for 2 to 3 minutes using balls of 3 mm in diameter. Likewise, in order to obtain a nanostructured layer of about 10 μm, it is necessary to expose the surface to be treated to an ultrasonic generation of nanostructures for about 400 s with balls of 300 μm in diameter. Likewise, experience has shown that the treatment time for generating nanostructures in common metal alloys or materials is between 50 and 1300 s, and that the diameter of the balls used is between 300 μm and 3 mm. The total time required may be prolonged or reduced depending on the material. In essence, for a given ball size and a given material, the nanostructure generating time is determined based on the nanostructured thickness desired by the user.

Thus, the method for generating nanostructures according to the invention is characterized by the fact that it comprises:

- a step for projecting onto the surface of the piece (10) to be treated, for a given duration, at a given speed, and at variable incidences at the same impact point, a given quantity of perfectly spherical balls (22) of given dimensions, reused continuously during the projection;
- repetition of the preceding step, with a shifting of the impact point, so that the impact points as a group cover the entire surface of the piece to be treated;
- a step for chemical treatment during at least part of the nanostructure generating time.

In another embodiment, the treatment step is a nitriding comprising the placement of the piece (10) to be treated in a nitrogen atmosphere, at a given temperature between 350 and 550° C., for a given amount of time between 30 minutes and 10 hours.

In another embodiment, the treatment step includes a case hardening in the metal structure of the piece.

In another embodiment, the treatment step includes a carbonitration.

In another embodiment, the treatment step includes an ion implementation.

In another embodiment, the treatment step includes a thermochemical treatment in which diffusion plays an active role.

In another embodiment, the projection step is performed after having filled the chamber into which the nanostructure generating device is placed with inert gas.

In another embodiment, the projection step is performed after having filled the chamber with chemically active gas.

In another embodiment, the generating method includes a step for placing the metal piece (10) to be treated under mechanical and/or thermal stress.

In another embodiment, the step for projecting the balls (22) is performed by means of an ultrasonic generator (20) in which the sound waves cause the balls (22) to move in random directions.

In another embodiment, the diameter of the perfectly spherical balls (22) is between 300 μm and 3 mm, depending on the thickness of the nanostructured layer desired by a user.

In another embodiment, for a given ball size and a given material constituting the piece (10), the projection time is determined based on the nanostructured thickness desired by the user.

In another embodiment, the projection time of the balls (22) is between 30 and 1300 s.

In another embodiment, the treatment is performed at low temperatures, lower than the ambient temperature.

Lastly, the device for generating nanostructures in a given thickness of a metal piece (10) comprising means for setting balls (22) of given dimensions in motion at a given speed is characterized in that the balls (22) used are perfectly spherical and that the means for setting them in motion at a given speed include means for obtaining variable angles of incidence the same impact point, means for reusing the balls (22), and means (26) for diffusing a chemical compound in a sealed chamber (25).

In another embodiment, the generating device includes means for placing the metal piece (10) under stress and/or means for heating the piece (10).

In another embodiment, the means for setting the balls (22) in motion include an ultrasonic generator (20) causing the balls (22) to move in random directions, the means for reusing the balls (22) being constituted by the chamber of the ultrasonic generator.

In another embodiment, the device for generating nanostructures includes means for adjusting the distance (d) between the emission source of the balls and the piece to be treated.

In another embodiment, the distance is on the order of 4 to 40 mm.

In another embodiment, the distance is preferably on the order of 4 to 5 mm.

In another embodiment, the device for generating nanostructures includes means for adjusting the emission time of the balls and their speed.

In another embodiment, the balls are of a quantity such that, when the means for setting them in motion using ultrasound are inactive, they occupy a surface area greater than 30% of the surface of the sonotrode.

In another embodiment, the speed is between 5 and 100 mps.

In another embodiment, the speed is on the order of 5 to 30 mps.

In another embodiment, the means for setting the balls (22) in motion include means for projecting a stream of balls (22) at an angle of incidence of the balls (22) relative to the surface of the piece (10) that is variable as a function of time, and means for producing a relative movement of the projection means parallel to the piece when several angles of incidence have been produced at the same impact point.

In another embodiment, the device for generating nanostructures includes means for performing a local cooling of the treated area of the piece.

In another embodiment, the projection time of the balls (22) is between 30 and 1300 s.

In another embodiment, the device is enclosed in an acoustic isolation chamber (25).

It should be clear to those skilled in the art that the present invention allows for embodiments in many other specific forms without going beyond the scope of application of the invention as claimed. Consequently, the present embodiments should be considered illustrative, but can be modified within the range defined by the scope of the attached claims, and the invention should not be limited to the details given above.

We claim:

1. Device for generating nanostructures in a given thickness of a metal piece (10) comprising means for setting in motion at a given speed, balls (22) of given dimension, the balls (22) being perfectly spherical, and the means for setting them in motion at a given speed includes means for obtaining variable angles of incidence for a same impact point, means for reusing the balls (22), and means (26) for diffusing a chemical compound in a sealed chamber (25), wherein said means for setting the balls (22) in motion further comprises:

means for projecting a stream of balls (22) at an angle of incidence of the balls (22) relative to the surface of the metal piece (10) that is variable as a function of time; and means for producing a relative movement of the projecting means parallel to the metal piece when several angles of incidence have been produced at the same impact point.

2. Device for generating nanostructures in a given thickness of a metal piece (10) according to claim 1, further comprising means for placing the metal piece (10) under stress and/or means for heating the metal piece (10).

3. Device for generating nanostructures in a given thickness of a metal piece (10) according to claim 1, wherein the device further includes means for adjusting a distance (d) between an emission source of the balls and the metal piece.

4. Device for generating nanostructures in a given thickness of a metal piece (10) according to claim 3, wherein the distance is from 4 to 40 mm.

5. Device for generating nanostructures in a given thickness of a metal piece (10) according to claim 4, wherein the distance is from 4 to 5 mm.

6. Device for generating nanostructures in a given thickness of a metal piece (10) according to claim 1, wherein the device further includes means for adjusting an emission time of the balls and their speed.

7. Device for generating nanostructures of a metal piece (10) according to claim 1, wherein the balls are of a quantity such that, when said means for setting them in motion are inactive, the balls occupy a surface area greater than 30% of the surface of a sonotrode of an ultrasonic generator (20) used for setting the balls in motion.

8. Device for generating nanostructures in a given thickness of a metal piece (10) according to claim 1, wherein the device further includes means for performing a local cooling of a treated area of the metal piece.

9. Device for generating nanostructures in a given thickness of a metal piece (10) according to claim 1, wherein the device is enclosed in an acoustic isolation chamber (25).

* * * * *